United States Patent [19]

Maillard

[11] 4,222,022

[45] Sep. 9, 1980

[54] VARIABLE INDUCTOR

[75] Inventor: Gilbert Maillard, Paris, France

[73] Assignee: Thomson-CSF, Paris, France

[21] Appl. No.: 54,695

[22] Filed: Jul. 5, 1979

[30] Foreign Application Priority Data

Jul. 10, 1978 [FR] France ..... 78 20539

[51] Int. Cl.[3] ..... H01F 29/06

[52] U.S. Cl. ..... 336/139

[58] Field of Search ..... 336/137, 139, 140, 141; 338/143, 146, 147, 148; 334/72

[56] References Cited

U.S. PATENT DOCUMENTS 1,831,375 11/1931 Adams, Jr. ..... 336/140

2,883,501 4/1959 Paget ..... 336/141 X

*Primary Examiner*—Thomas J. Kozma

*Attorney, Agent, or Firm*—Roland Plottel

[57] ABSTRACT

In a variable inductor of the type comprising a helical winding, the pressure exerted by the slider on the conductor of the winding decreases when the slider undergoes a high-speed displacement. A separating device is associated with the slider and, under the action of the centrifugal force produced at the time of a high-speed displacement of the slider, tends to move said slider away from its point of application on the conductor and therefore to reduce the pressure at the point of contact between the slider and the conductor. Wear resulting from displacements of the slider is thus minimized.

4 Claims, 2 Drawing Figures

VARIABLE INDUCTOR

This invention relates to a variable inductor comprising a fixed winding formed by a conductor wound in a circular helix and a slider applied against the conductor, displacement of the point of application of the slider on the conductor being performed in a screwing movement of the slider about the axis of the helix.

In variable inductors of known types, the slider is placed inside the helix in such a manner as to bear on the conductor and to be capable of sliding on this latter; said slider provides an electrical connection with a conductive rotary shaft disposed along the principal axis of the helix and is capable of longitudinal displacement on said conductive shaft. The movement of rotation of the conductive shaft causes displacement of the slider on the conductor and this latter serves as a guide rail for the slider.

Inductors of this type are usually employed in medium-power transmitters and in the matching circuits of associated antennae.

In most instances, the conductive shaft of the inductor is driven in rotation by means of a motor which has a high speed of rotation in order to ensure rapid positioning of the slider and which also permits of remote control or follow-up control in automatic tuning devices.

The rapid positioning just mentioned involves high-speed sliding motion of the contact on the conductor. In order to limit wear of the contact and/or of the conductor, the pressure exerted by the slider on said conductor must remain low in value during the high-speed displacement of the slider. It should be noted, however, that said high-speed displacement of the slider is related in the great majority of instances to a low current within the inductor and therefore to a current which does not require a high contact pressure between the slider and the conductor.

On the other hand, in the inoperative condition or at low speeds corresponding to the end of a follow-up control period, the maximum current flows through the inductor and the contact pressure must be of high value in order to limit the resistance and overheating at the point of contact.

In the case of known variable inductors, the contact pressure is fixed and is usually of fairly high predetermined value; as has been noted in the foregoing, this is wholly suitable when the slider is either stationary or displaced at low speed along the conductor but is conducive to substantial wear of the contact and/or of the conductor at the time of rapid positioning.

The aim of the present invention is to reduce the disadvantages just mentioned and if possible to remove them altogether.

This aim is achieved by means of a slider adapted to exert on the conductor a contact pressure which is related to the speed of sliding motion of the slider and therefore to the speed of rotation of the conductive shaft of the inductor.

According to the invention, there is provided a variable inductor comprising a fixed winding constituted by a conductor wound in a circular helix, a slider for making contact under pressure at a point of application of said slider on said conductor, means for displacing the point of application of the slider along the conductor in a screwing movement of the slider about the geometrical axis of the helix, and a separating device having a tendency to reduce the pressure exerted by the slider on the conductor under the action of the centrifugal force produced by the screwing movement of said slider.

A more complete understanding of the present invention will be gained from the following description in which further distinctive features will appear, reference being made to the accompanying drawings in which.

Figure 1:
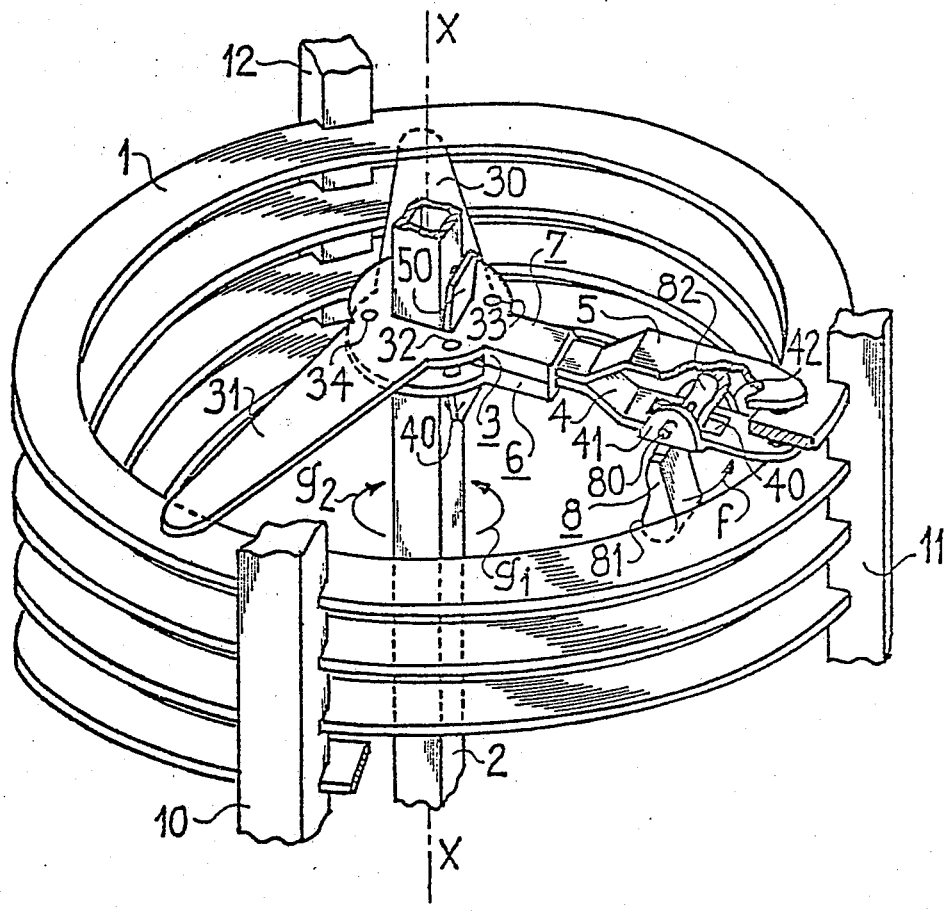
FIG. 1 is a view of a portion of a first variable inductor according to the invention.

For the sake of ease and convenience in reading the drawings, the only variable inductor components shown in FIG. 1 are those which are necessary for a clear understanding of the invention. For the same reasons, certain elements of the inductor do not conform to their intended dimensions in this figure.

There are shown in FIG. 1:

approximately four turns of the winding 1 of a variable inductor;

a portion of each of three insulating bars 10, 11, 12 which are placed around the winding 1 and serve to attach this latter;

a rotary shaft 2 of square cross-secton, the geometrical axis of rotation of said shaft being designated by the line X—X;

a slider 3.

The winding 1 is formed of rectangular-section conducting wire having a thickness of 1.5 mm and a width of 8 mm. Said winding is constituted by a total of about fifty turns of wire which are wound in the form of a circular helix having an axis X—X. The dimensions of the winding are: overall length 300 mm, diameter 120 mm.

The insulating bars 10, 11, 12 are formed of rigid plastic and provided with notches 2 mm in depth in which the conducting wire of the winding is supported. Said insulating bars are disposed at angular intervals of 120° about the axis X—X and serve as spacer members for the end-plates (not shown) of the variable inductor.

The rotary shaft 2 is a hollow tube of square cross-section having dimensions of 18×18 mm and formed of silver-bearing copper; said shaft is connected to the end-plates in the vicinity of the shaft ends (not shown in the drawings) by means of plastic bearings. One end of the shaft 2 passes through one of the end-plates of the inductor and is intended to be coupled to the drive shaft of a motor.

The slider 3 comprises:

two resilient strips 4, 5 of spring bronze having a width of 10 mm and a thickness of five tenths of a millimeter. Said strips are bent-back substantially at right angles in the vicinity of their first end portions 40, 50 and are applied in contact with one of the faces of the square shaft 2 in the vicinity of the same end portion by means of silver contacts soldered to the strips. Said silver contacts are identical with the silver contacts which will be shown in FIG. 2. The strips 4 and 5 are applied against each other in their central portions and diverge in the vicinity of their second end portions so as to form a tong-type unit, the two arms of which terminate on each side of the same point of the winding 1. In this case also, a contact is established by means of silver contacts soldered to the strips;

two insulating guides 6, 7 each constituted by a circular portion pierced by a hole through which the shaft 2 passes and by one of the bent-back end portions of the strips (end portion 40 in the case of the guide 6 and end portion 50 in the case of the guide 7). The two guides 6 and 7 are provided respectively with two tongues 30, 31 which form a three-branch star with the strips 4, 5, and two channel-shaped portions disposed along that branch of the star which is occupied by the strips, each strip being thus maintained in the central portion thereof inside the channel of one of the guides. The strips 4, 5 and the guides 6, 7 are united in rigidly fixed relation by means of three rivets 32, 33, 34 which join together the circular portions of the guides. Thus the resilient strips grip one turn of the winding 1 whilst the guides 6 and 7 located at an angle of 120° on each side of the resilient strips are applied respectively beneath and above the turn aforesaid. From this it accordingly follows that, when the shaft 2 rotates (in the direction of the arrows $g_1$ or $g_2$), the star-shaped slider is continuously maintained in a plane which is substantially perpendicular to the shaft 2 and the gripping point between the resilient strips 4, 5 and the conductor 1 slides along said conductor.

The slider 3 further comprises a device for separating the two resilient strips 4, 5. Said separating device 8 comprises a counterweight 81 of 0.5 gram and a lever 82 which are located on each side of a small pivot-pin 80 and form one piece with this latter. Part of the resilient strip 5 has been broken away in the figure in order to provide a clearer view of the separating device. In that portion of the resilient strip 4 which forms one of the tong-arms of the slider, provision is made for a hole 40 and for two tongues bent-back at right angles on each side of said hole. Said tongues are each pierced by a circular hole and serve as bearing-brackets for the small pivot-pin 80; thus said pivot-pin 80 and the lever 81 are both located within the tong-arms of the slider; the counterweight 81 is joined to said small pivot-pin 80 through the hole 40.

When the slider is in the rest position, the lever 82 just touches the resilient strip 5. On the other hand, when the slider is displaced in rapid motion (10 revolutions per second in a case considered by way of example and corresponding to an end-to-end displacement of the winding in 5 seconds in respect of a winding length of 17 meters), the counterweight 81 undergoes a displacement (in the direction of the arrow f), thus producing a pivotal movement of the lever 82. The force applied by the lever on the strip 5 in order to move this latter away from the strip 4 is larger as the centrifugal force is of greater magnitude. Thus the pressure exerted by the resilient strips on the winding is of reduced value during rapid displacements of the slider, the wear of the slider and of the winding being consequently reduced in comparison with a variable inductor of the conventional type which is similar to that of FIG. 1 but not provided with a device for separating the resilient strips.

The variable inductor described in the foregoing is intended to operate with a mean high-frequency current of 12 amps when the slider is stationary or is passing over the last turn before its stopping point and with a mean high-frequency current of 0.5 amp when the slider is displaced in rapid motion.

Figure 2:
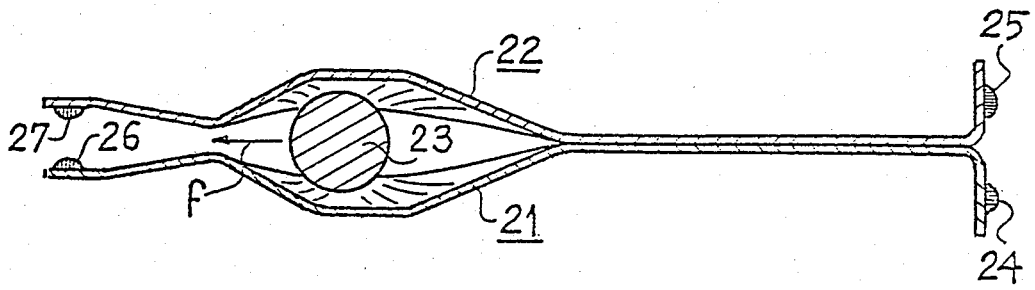
FIG. 2 illustrates elements of a second variable inductor according to the invention.

FIG. 2 is a sectional view showing an assembly constituted by two resilient strips 21, 22 and by a device 23 for separating said strips. This assembly replaces the assembly constituted by the members 4, 5 and 8 of FIG. 1 and serves to constitute another variable inductor according to the invention. In this alternative embodiment, the separating device 23 is constituted by a steel ball which is placed and held in position within a cavity between two oppositely-facing concave portions of bosses formed respectively in each of the two resilient strips.

There are also shown in FIG. 2 four silver contacts 24 to 27 which are soldered to the strips. Said contacts have the shape of half-spheres approximately 5 mm in diameter and are intended to make a sliding contact between the slider and the inductor shaft (contacts 24, 25) as well as the winding (contacts 26, 27).

Under the action of the centrifugal force (arrow f) produced by the high-speed rotation of the variable inductor shaft, the ball is displaced and tends to separate the tong unit formed by the two end portions of the resilient strips which terminate in the contacts 26, 27, thereby reducing the pressure force exerted by the slider on the winding.

Variable inductors of different types may be contemplated without thereby departing from the scope of the invention. In these inductors, provision is made for a slider in conjunction with a first device for exerting pressure on the winding and a second device for automatically reducing the pressure exerted on the winding by the first device, this being achieved under the action of the centrifugal force produced by the high-speed rotation of the inductor shaft. For example, this is the case with an inductor in which the slider comprises a sliding arm and, at the end of said arm:

a small rod rotatably mounted on a shaft which is rigidly fixed to the arm, a roller which is secured to one end of the rod and comes into contact with the conductor of the winding;

a counterweight which is rigidly fixed to the other end of the rod and tends to reduce the pressure exerted on the conductor by the roller during a high-speed movement of rotation of the inductor shaft;

and a spring which is fixed between the arm and the rod and tends to increase the pressure exerted on the conductor by the roller.

What is claimed is:

1. A variable inductor comprising a fixed winding constituted by a conductor wound in a circular helix, a slider for making contact under pressure at a point of application of said slider on said conductor, means for displacing the point of application of the slider along the conductor in a screwing movement of the slider about the geometrical axis of the helix, and a separating device having a tendency to reduce the pressure exerted by the slider on the conductor under the action of the centrifugal force produced by the screwing movement of said slider.

2. An inductor according to claim 1, wherein the slider comprises a tong unit constituted by two oppositely facing members which serve to grip the conductor and wherein the separating device is associated with the two oppositely facing members, thereby tending to separate said two oppositely facing members under the action of the centrifugal force produced by a screwing movement of said slider.

3. An inductor according to claim 2, wherein the two oppositely facing members are two resilient strips and wherein the separating device comprises a bearing rigidly fixed to one of the resilient strips, a pivot-pin rotatably mounted within said bearing, a lever rigidly fixed at one end to the pivot-pin and a counterweight rigidly fixed to said pivot-pin for tending to displace the pivot-pin in rotation and to apply the lever against the other resilient strip under the action of the centrifugal force produced by a screwing movement of the slider.

4. An inductor according to claim 2, wherein the two oppositely facing members are two resilient strips each having a hollow portion, wherein the hollow portions of the two strips are placed in oppositely facing relation so as to form a cavity and wherein the separating device comprises a ball placed within the cavity and tending to pass out of said cavity under the action of the centrifugal force produced by a screwing movement of the slider.

* * * * *